US007603942B1

(12) United States Patent
Hanser et al.

(10) Patent No.: US 7,603,942 B1
(45) Date of Patent: Oct. 20, 2009

(54) SYNCHRONIZATION CYLINDER HAVING CHAMBERS WITH DIFFERENT VOLUMES

(75) Inventors: Paul Edmund Hanser, Tipton, IA (US); Marc Frerichs, Eldridge, IA (US)

(73) Assignee: HWH Corporation, Moscow, IA (US)

( * ) Notice: Subject to any disclaimer, the term of this patent is extended or adjusted under 35 U.S.C. 154(b) by 184 days.

(21) Appl. No.: 11/536,816

(22) Filed: Sep. 29, 2006

(51) Int. Cl.
*F15B 11/22* (2006.01)
*F01B 7/16* (2006.01)

(52) U.S. Cl. ..... 91/515; 60/546

(58) Field of Classification Search ..... 60/546, 60/581, 593; 91/515; 92/152
See application file for complete search history.

(56) References Cited

U.S. PATENT DOCUMENTS

| | | | | | |
|---|---|---|---|---|---|
| 2,983,256 | A | * | 5/1961 | Seeloff | 92/151 |
| 3,579,989 | A | * | 5/1971 | Stark et al. | 60/546 |
| 3,590,581 | A | * | 7/1971 | Bianchi | 92/146 |
| 3,783,620 | A | * | 1/1974 | Moe | 60/581 |
| 4,161,229 | A | | 7/1979 | Mifsud | |
| 4,409,884 | A | | 10/1983 | Boehringer | |
| 4,531,451 | A | | 7/1985 | Mouton | |
| 4,567,727 | A | * | 2/1986 | Grams | 60/581 |
| 4,624,126 | A | * | 11/1986 | Avila et al. | 91/515 |
| 6,050,430 | A | | 4/2000 | Fleagle et al. | |
| 6,052,952 | A | | 4/2000 | Frerichs et al. | |
| 6,408,736 | B1 | | 6/2002 | Holt et al. | |
| 7,047,738 | B2 | | 5/2006 | Bair | |
| 2004/0020197 | A1 | * | 2/2004 | Cray | 60/485 |
| 2005/0172797 | A1 | * | 8/2005 | Bair | 91/508 |

* cited by examiner

*Primary Examiner*—Michael Leslie
(74) *Attorney, Agent, or Firm*—Jason R. Sytsma; Shuttleworth & Ingersoll, PLC

(57) ABSTRACT

A synchronizing cylinder that allows for the synchronized movement of multiple hydraulic mechanism cylinders having different sizes and volumes. In one embodiment, the synchronizing cylinder has a first chamber in fluid communication with a first mechanism cylinder and a second chamber in fluid communication with a second mechanism cylinder. The first mechanism cylinder has a first volume and the second mechanism cylinder has a second volume wherein the volume of the first mechanism cylinder is smaller than the volume of the second mechanism cylinder. The volume of the fluid being pushed from (or received by) the first chamber in the synchronizing cylinder is less than the volume of fluid being pushed from (or received by) the second chamber in the synchronizing cylinder so that the first and second mechanism cylinders extend and retract at the same speed and distance regardless of the smaller size and volume of the first mechanism cylinder.

1 Claim, 5 Drawing Sheets

SYNCHRONIZATION CYLINDER HAVING CHAMBERS WITH DIFFERENT VOLUMES

BACKGROUND OF THE INVENTION

A variety of vehicles are known and used which have a room or a room portion that may be moved from a retracted position while the vehicle is moving over the road and then expanded when the vehicle is stationary in order to provide additional internal space. This type of an arrangement provides adequate space to accommodate users in transit while still keeping the vehicle within governmental regulations that impose width limitations for vehicles on roads and highways. When these vehicles are stationary, they are frequently used for habitation for extended periods of time, and when so used, it is highly desirable to be able to maximize the available living space.

In the past, most vehicles have used two identical hydraulic cylinders combined along the base portion of the expandable room to expand and retract the room. (The cylinders that expand and retract the room are referred to herein as "mechanism cylinders" since they combine with the mechanism that is being moved by the hydraulic power.) In conjunction with the mechanism cylinders, some prior art devices have employed a synchronizing cylinder to keep the mechanism cylinders moving at the same speed and distance. Synchronizing cylinders are generally described in U.S. Pat. Nos. 4,409,884 (Boehringer) and 6,408,736 (Holt et. al.) which are hereby incorporated by reference. In general, prior art synchronizing cylinders make the same volume of fluid move at the same rate of flow to or from each identical mechanism cylinder so that all mechanism cylinders move the same distance at the same speed.

Recently, the length and weight of expandable rooms has increased as recreational vehicle users have desired more square footage inside their vehicles. Because of the increased length and weight of expandable rooms, many recreational vehicle manufactures are now employing four hydraulic mechanism cylinders to expand and retract expandable rooms, rather than two. Typically, one mechanism cylinder is located near each corner of the room so that there are two upper mechanism cylinders and two lower mechanism cylinders. In addition to the increased strength and rigidity provided by using four cylinders instead of two, the four mechanism cylinder arrangement helps to provide a better seal between the room and the recreational vehicle when the expandable room is in its retracted position.

One problem with using four mechanism cylinders is that there is limited space above the ceiling in a recreational vehicle for the two upper mechanism cylinders to be mounted. Because of this limited space, it is desirable for the upper mechanism cylinders to be smaller in diameter than the lower mechanism cylinders while retaining the same stroke length as the lower mechanism cylinders.

Therefore, there is a need for a synchronizing cylinder that provides for the synchronization of mechanism cylinders having different fluid volumes yet are required to travel the same distance.

SUMMARY OF THE INVENTION

The invention comprises a synchronizing cylinder that allows for the synchronized movement of multiple hydraulic mechanism cylinders. The synchronizing cylinder comprises a chamber for each mechanism cylinder that is controlled thereby and a piston in each chamber to move the hydraulic fluid. The pistons are combined together with a rod so that the movement of one piston causes the other pistons to move the same distance at the same speed. As is known in the art, the pistons comprise a cap side and a rod side. In the respective chambers, the cap side of the pistons are tied together hydraulically however, the rod side of the pistons are isolated from each other. When the synchronizing cylinder moves, the volume of fluid in the chambers moves to or from the rod sides of the synchronizing cylinder to move the mechanism cylinders. The volume of fluid moving to or from the synchronizing cylinder chambers and the volume of fluid received by the mechanism cylinders determines how far the mechanism cylinders travel.

In one embodiment, two mechanism cylinders are controlled by the synchronizing cylinder. In this embodiment, the synchronizing cylinder comprises a first chamber in fluid communication with a first mechanism cylinder and a second chamber in fluid communication with a second mechanism cylinder. In this embodiment, the first mechanism cylinder comprises a first volume and the second mechanism cylinder comprises a second volume wherein the volume of the first mechanism cylinder is smaller than the volume of the second mechanism cylinder. The volumes of the respective synchronizing cylinder chambers are adapted to contain a predetermined amount of fluid so that the mechanism cylinders extend and retract at the same speed and distance. In other words, the volume of the hydraulic fluid being pushed from (or received by) the first chamber in the synchronizing cylinder is less than the volume of hydraulic fluid being pushed from (or received by) the second chamber in the synchronizing cylinder so that the first and second mechanism cylinders extend and retract at generally the same speed and distance regardless of the smaller volume of the first mechanism cylinder.

DESCRIPTION OF THE PREFERRED EMBODIMENTS OF THE INVENTION

The invention comprises a synchronizing cylinder 20 that allows for the synchronized movement of multiple hydraulic mechanism cylinders 22, 24. It should be noted that the invention may be used in any application requiring a synchronizing cylinder 20 which controls the synchronized movement of multiple mechanism cylinders 22, 24 wherein the mechanism cylinders 22, 24 have different volumes; however, the invention will be described herein as it would be used with an expandable room 12 of a recreational vehicle 10. It should further be noted that although the invention is described herein as being used with hydraulic fluid, one skilled in the art will recognize that any other suitable fluid may be used.

Figure 1:
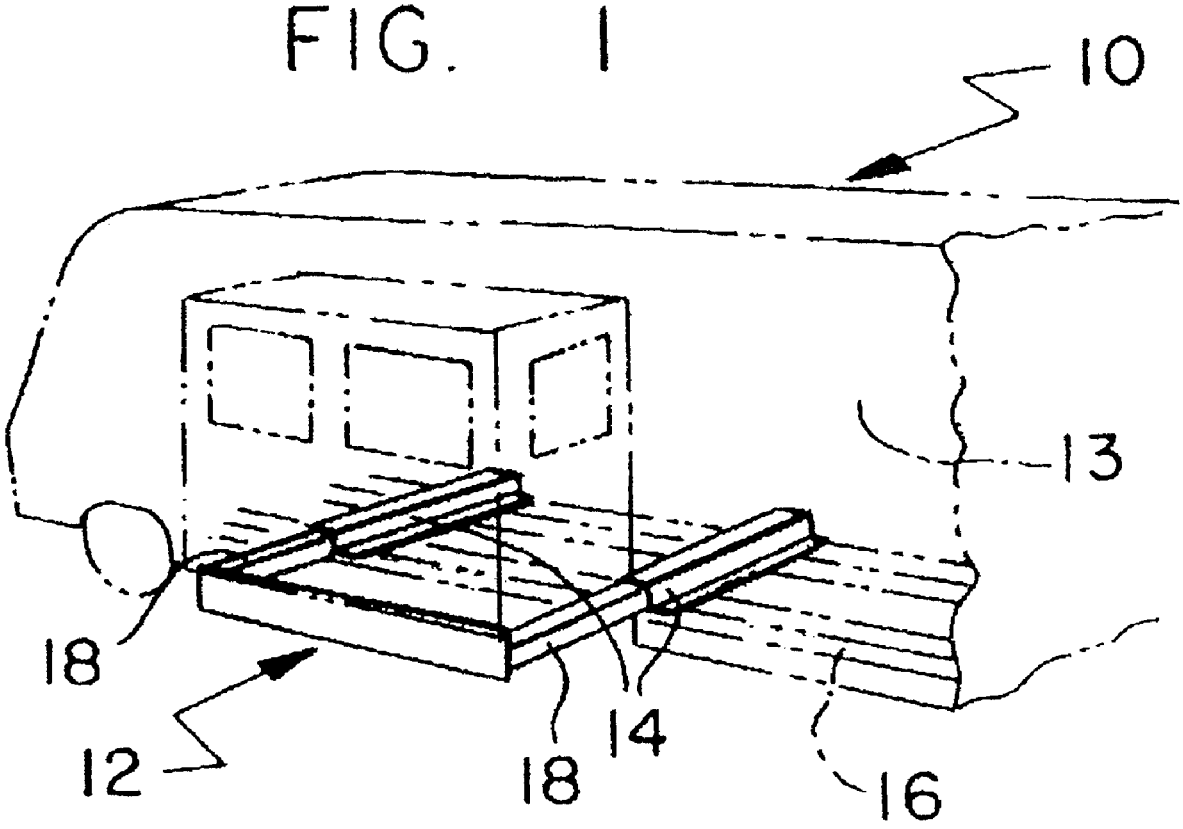
FIG. 1 is a perspective view of a representation of a recreational vehicle with an expandable room showing the room in the expanded position (the mechanism cylinders are not shown)

Referring first to FIG. 1, there is illustrated a motor vehicle such as a recreational vehicle 10 that has extending from its left side an expandable room indicated generally by the reference numeral 12. FIG. 1 shows the expandable room in its extended position to provide additional living space inside of the recreational vehicle 10 when the vehicle 10 is stationary, such as at a campsite. As is known to those skilled in the art, when the vehicle 10 is traveling over the road, the expandable room 12 is retracted so that the side wall of the expandable room 12 is flush with an exterior wall 13 of the recreational vehicle 10. As shown in FIG. 1, the expandable room 12 may be supported by a pair of main support beams 14 that are affixed to the frame 16 of the recreational vehicle 10 and thus are fixed relative to the expandable room 12. A moveable inner tube 18 is mounted on each of the main support beams 14 for movement inwardly to a retracted position and outwardly to an expanded position, the inner tubes 18 having their outer ends affixed to the expandable room 12.

Figure 2:
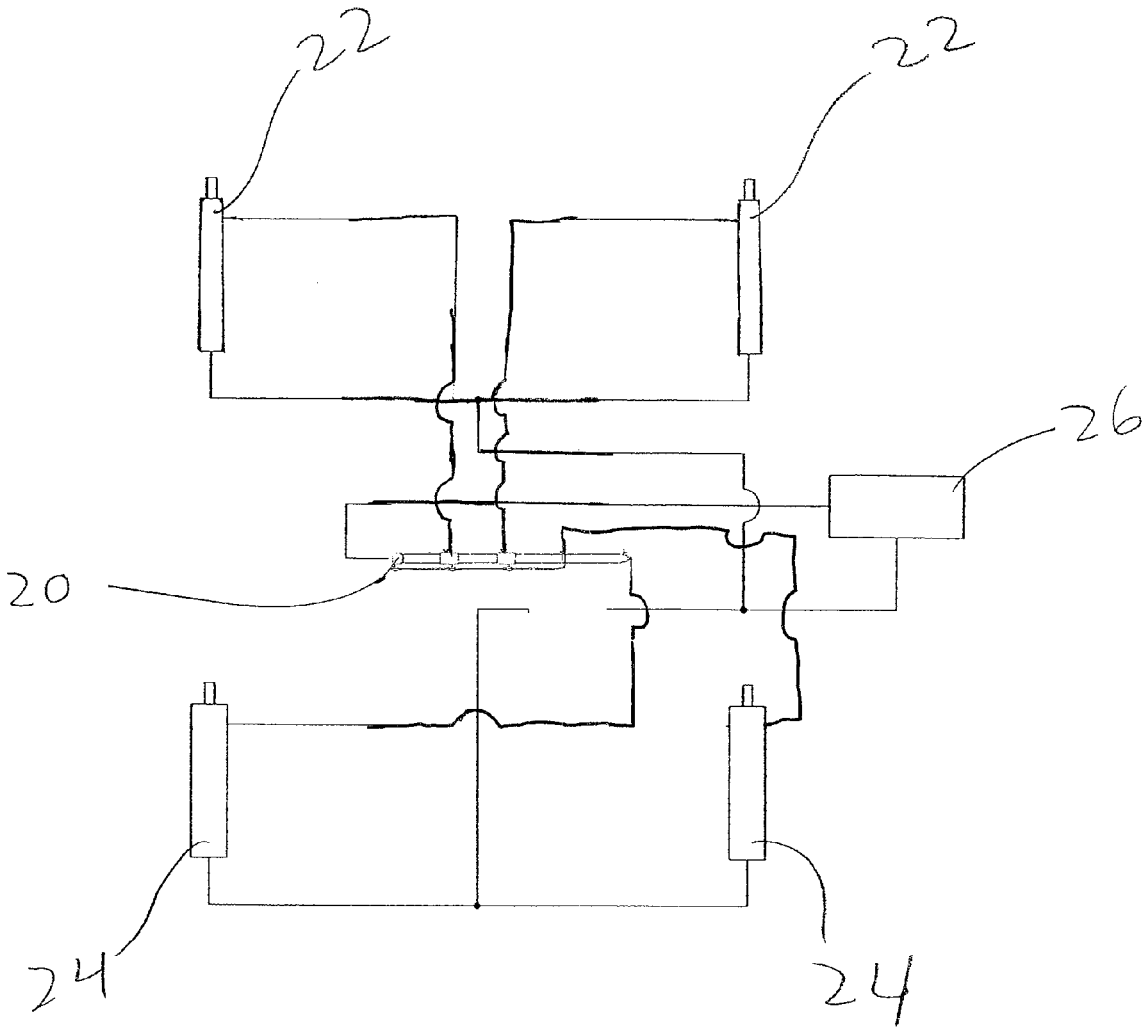
FIG. 2 is a diagram of an embodiment of the present invention showing the synchronizing cylinder in communication with mechanism cylinders having different volumes.

The room 12 is moved from its retracted position to its extended position with the aid of hydraulic mechanism cylinders 22, 24. As shown in FIG. 2, one embodiment of the invention comprises four hydraulic mechanism cylinders 22, 24 to expand and retract the expandable room 12. In this embodiment, the mechanism cylinders 22, 24 are positioned so that there are two upper mechanism cylinders 22 and two lower mechanism cylinders 24. As seen in FIG. 2, the two upper mechanism cylinders 22 comprise a first volume and the two lower mechanism cylinders 24 comprise a second volume wherein the first volume is less than the second volume.

FIGS. 3-7 show embodiments of the synchronizing cylinder 20 that allow for the synchronized movement of the hydraulic mechanism cylinders 22, 24. In one embodiment, the synchronizing cylinder 20 and hydraulic mechanism cylinders 22, 24 operate on a regenerative circuit, as is known in the art. The synchronizing cylinder 20 comprises a chamber 30, 32 in communication with each mechanism cylinder 22, 24 that is controlled thereby. A piston 34 in each chamber 30, 32 moves the hydraulic fluid into and out of the chamber 30, 32. The volume of chambers 30 are smaller than the volume of the chambers 32 and are in communication with the smaller volume mechanism cylinders 22 via openings 50. The two larger volume chambers 32 are in communication with the larger volume mechanism cylinders 24 via openings 52. The pistons 34 are combined together with a rod 31, 33 so that the movement of one piston 34 causes the other pistons 34 to move the same distance at the same speed. As is known in the art, each piston 34 has a cap side and a rod side. In the respective chambers 30, 32, the cap sides of the pistons 34 are tied together hydraulically by a supply tube 56, however, the rod side of the pistons 34 are isolated from each other. This isolation of the rod sides of the pistons 34 ensures that when the synchronizing cylinder 20 moves, the same volume of fluid has to move to or from the rod sides of each chamber 30, 32. In an alternate embodiment, instead of a supply tube 56, portions of the rod 31, 33 may be hollow to allow the cap side of the pistons 34 to be hydraulically tied together. In yet another alternate embodiment, the rod sides of the pistons 34 can be fluidly combined and the cap sides can be isolated to produce the same result.

In the embodiment shown in FIG. 2, the upper mechanism cylinders 22 and lower mechanism cylinders 24 are controlled by the synchronizing cylinder 20. As noted above, the synchronizing cylinder 20 comprises a chamber 30, 32 for each mechanism cylinder 22, 24 that is controlled thereby. In this embodiment, the two first chambers 30 are separately in fluid communication with the two upper mechanism cylinders 22, and the two second chambers 32 are separately in fluid communication with the two lower mechanism cylinders 24. As illustrated in FIG. 2, the upper mechanism cylinders 22 comprises a first volume and the lower mechanism cylinders 24 comprises a second volume wherein the volume of the upper mechanism cylinders 22 is smaller than the volume of the lower mechanism cylinder 24. The chambers 30, 32 are adapted to contain a predetermined amount of hydraulic fluid so that the mechanism cylinders 22, 24 extend and retract at the same speed and distance. In other words, the volume of the hydraulic fluid being pushed from (or received by) the first chambers 30 in the synchronizing cylinder 20 is less than the volume of hydraulic fluid being pushed from (or received by) the second chambers 32 in the synchronizing cylinder 20. Therefore, the upper and lower mechanism cylinders 22, 24 extend and retract at the same speed and distance regardless of the smaller volume of the upper mechanism cylinders 22. The different chamber 30, 32 volumes are shown in dark shading in FIG. 6.

The invention comprises alternate embodiments for causing the volume of the hydraulic fluid being pushed from (or received by) the chambers 30, 32 of the synchronizing cylinder 20 to be different. In the embodiment shown in FIGS. 3, 4, and 6, the diameter of the two first chambers 30 is the same as the diameter of the two second chambers 32, however, the diameter of the rod 31 that passes through the two first chambers 30 is larger than the diameter of the rod 33 that passes through the two second chambers 32 thereby causing the volume of first chambers 30 to be smaller. The dark shaded portions of FIG. 6 show the volumes of the four chambers 30, 32, respectively.

Figure 7:
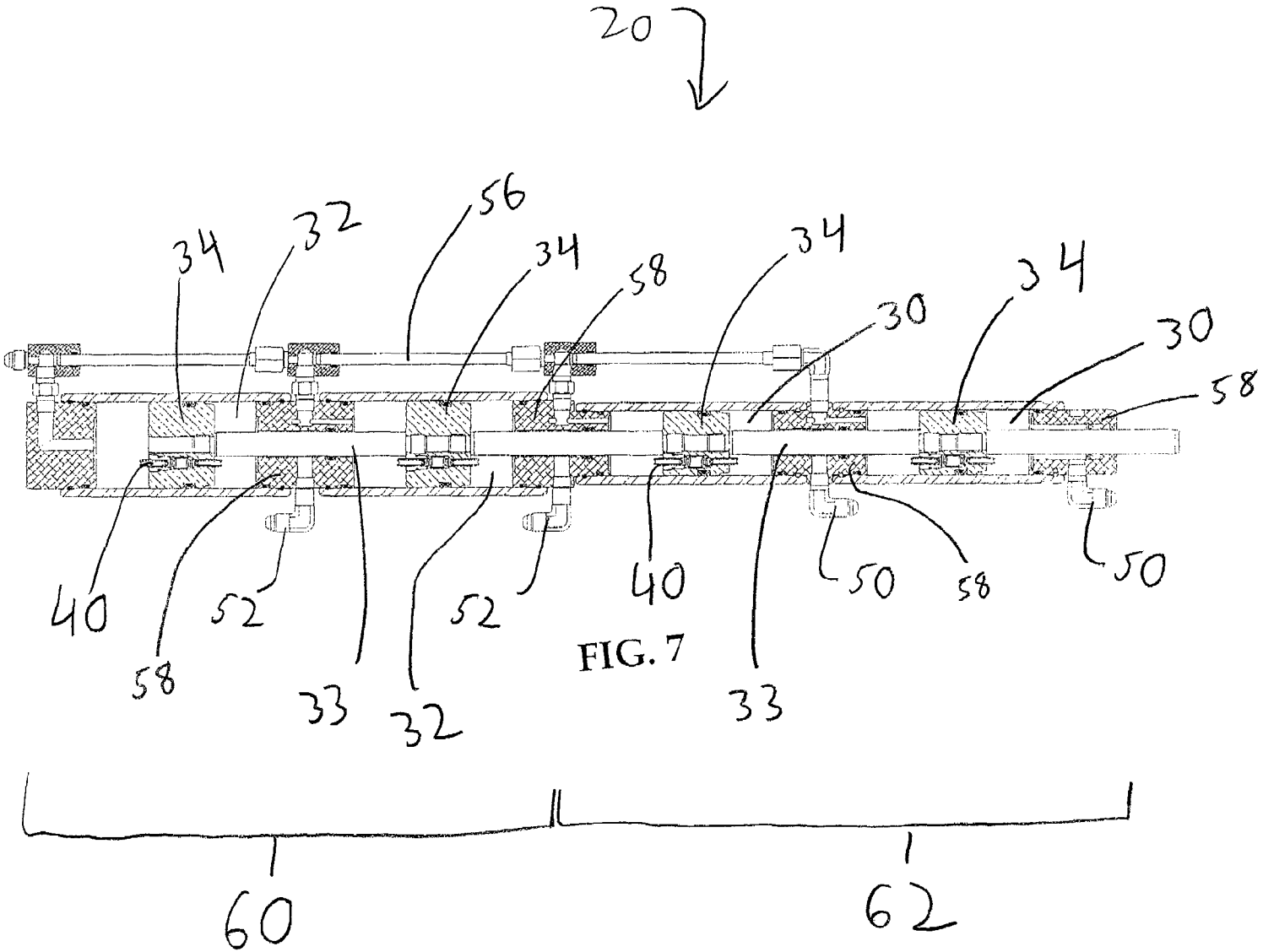
FIG. 7 is a longitudinal sectional view of the synchronizing cylinder showing an embodiment wherein the rod is the same size throughout the length of the synchronizing cylinder but the diameter of the synchronizing cylinder's chambers changes.

In an alternate embodiment shown in FIG. 7, the rod 31, 33 diameter remains constant throughout the entire length of the synchronizing cylinder 20, however, the diameter of the synchronizing cylinder 20 changes. As seen in FIG. 7, the diameter of the first portion 60 of the synchronizing cylinder 20 is larger than the diameter of the second portion 62 of the synchronizing cylinder 20. This creates a smaller volume in the chambers 30 in the second portion 62 of the synchronizing cylinder 20 than the chambers 32 in the first portion 60 of the synchronizing cylinder 20. In other words, the volume of the hydraulic fluid being pushed from (or received by) the first chambers 30 in the synchronizing cylinder 20 is less than the volume of hydraulic fluid being pushed from (or received by) the second chambers 32 in the synchronizing cylinder 20 so that the upper and lower mechanism cylinders 22, 24 extend and retract the same speed and distance regardless of the smaller volume of the upper mechanism cylinder 22.

Figure 4:
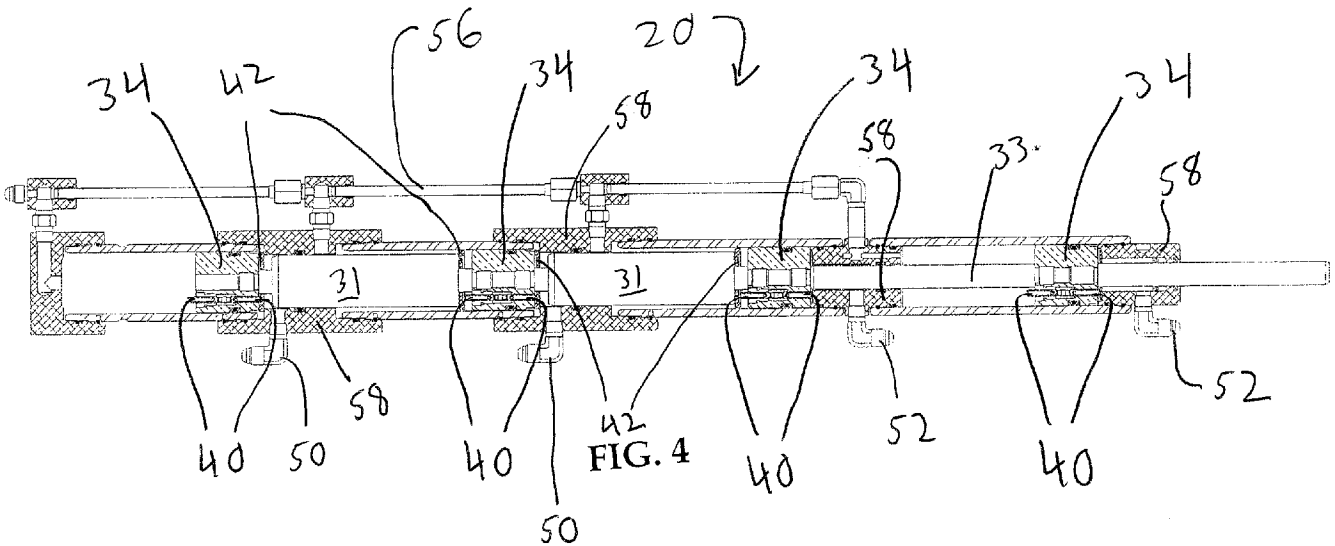
FIG. 4 is a longitudinal sectional view of the synchronizing cylinder with the pistons in a their extended position.
Figure 5:
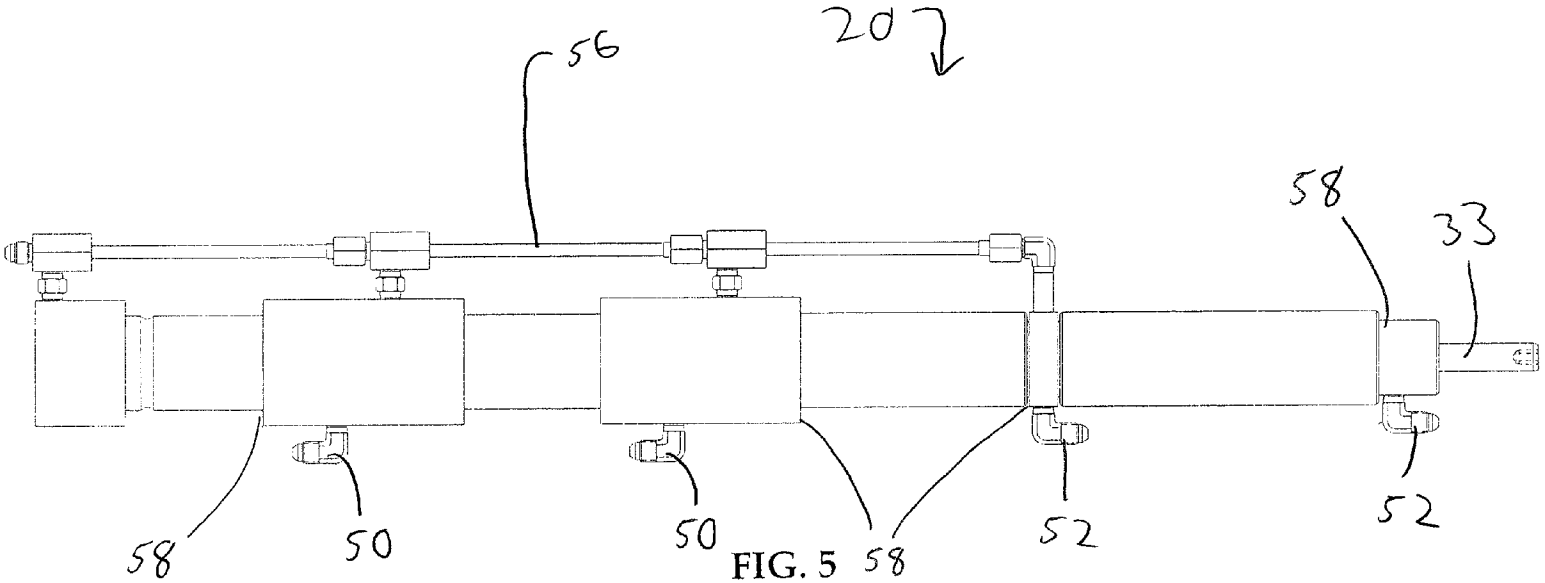
FIG. 5 is a side view of the synchronizing cylinder.

The use of synchronizing valves or poppets 40 with synchronizing cylinders 20 is generally known. As mentioned above, in one embodiment the cap side of the pistons 34 are tied together hydraulically, however, the rod side of the pistons 34 are isolated from each other during the synchronizing cylinder's 20 movement. As seen in the figures, the poppets 40 are combined with the pistons 34 so that as the pistons 34 get to the end of their stroke (FIG. 4), the poppets 40 contact a non-moving portion of the synchronizing cylinder 20 such as a rod guide 58. An example of this is shown in FIG. 4 wherein one of the poppets 40 in the piston 34 farthest to the right in the synchronizing cylinder 20 is being actuated by rod guide 58 that is located farthest to the right of the synchronizing cylinder 20. When the poppets 40 are actuated, they open and allow fluid communication between the cap side and rod side of the chambers 30, 32. This helps resynchronize the cylinders 22, 24 if one cylinder 22, 24 needs to stroke more than the others. This also helps bleed any air that is in the rod chamber back to the pump 26 (FIG. 2).

Figure 3:
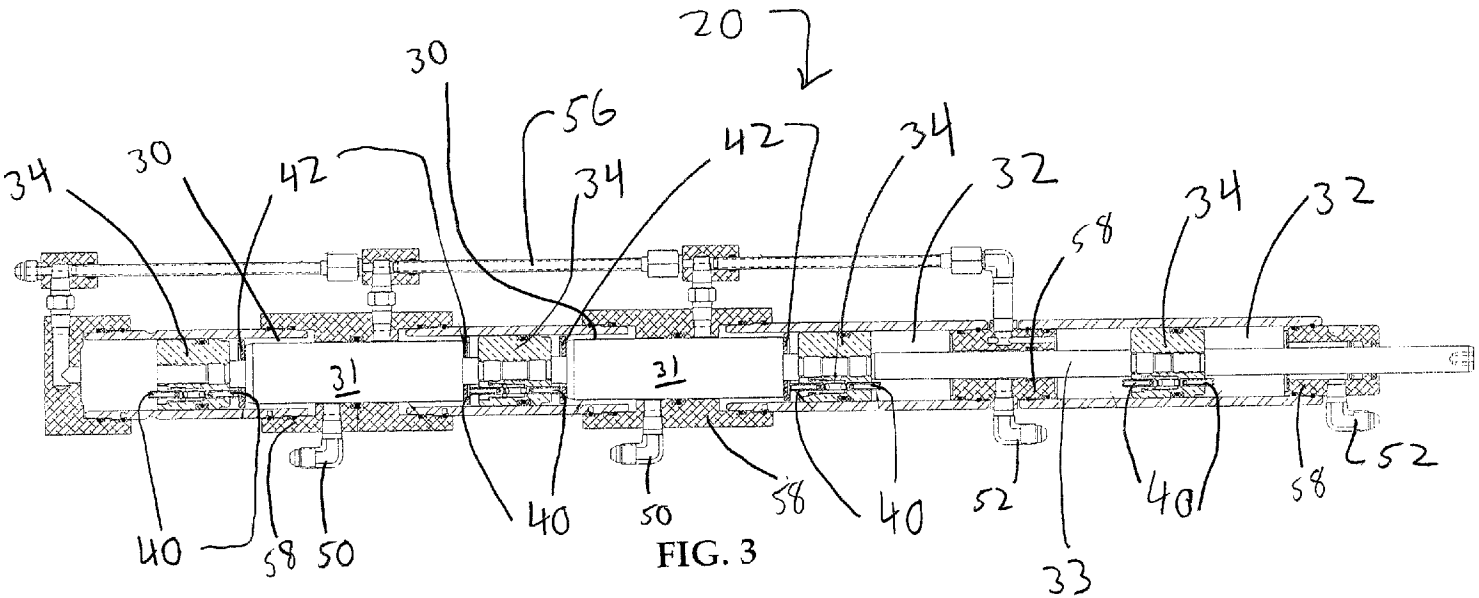
FIG. 3 is a longitudinal sectional view of an embodiment of the synchronizing cylinder wherein the rod diameter changes to affect the volume of the chambers.
Figure 6:
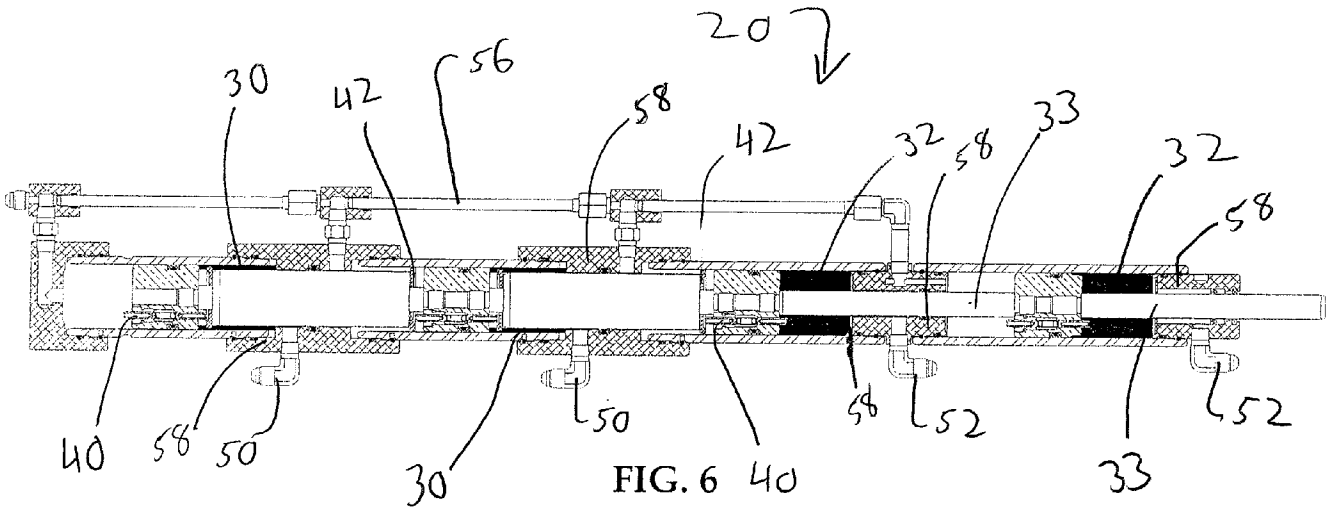
FIG. 6 is a longitudinal sectional view of the synchronizing cylinder showing the volumes of the different sized chambers in dark shading.

In the embodiment of the invention shown in FIGS. 3, 4, and 6 wherein some of the rods 31 are of a larger diameter than other rods 33, the poppets 40 are not able to come into contact with the rod guide 58 at the end of the stroke in some of the chambers 30, 32 due to the larger sized rods 31. An example of a poppet's 40 inability to contact the rod guide 58 due to the larger sized rods 31 can be seen by viewing the second piston 34 from the left in the synchronizing cylinder 20 in FIGS. 3 and 4. To overcome this problem and allow the poppets 40 to actuate at the end of their stroke, members 42 have been combined with the larger rod's 31 shank. Although the poppets 40 cannot contact the rod guide 58, the poppets 40 are able to contact members 42 at the end of their stroke and actuate the poppets 40. The members 42 are large enough that they are able to contact the rod guide 58 so that when the pistons 34 get to the end of their stroke, the members 42 contact the rod guide 58 and the poppets 40 contact the members 42. In other words, the members 42 provide an intermediary surface between the poppets 40 and the rod guide 58. FIG. 4 shows the synchronizing cylinder 20 fully extended wherein the pistons 34 are moved to the right hand portion of their respective chambers 30, 32. In this fully extended position, the members 42 are contacting the rod guide 58 and the poppets 40 are contacting the member 42, thereby opening the poppets 40.

When two or more mechanism cylinders 22, 24 are synchronized, a pressure intensification can occur in the chambers 30, 32 that supplies oil to the cylinders 22, 24. The pressure intensification can be up to the magnitude of the number of cylinders 22, 24 being synchronized times the operating pressure. This pressure is what stops the moving cylinder(s) 22, 24 from stroking when one of the cylinders 22, 24 becomes jammed. To correct for this, pressure switches can be used in each chamber of synchronizing cylinder 20 to monitor the pressure and shut the system down when a predetermined pressure is reached.

In some embodiments, the upper cylinders 22 are located above the ceiling of the coach, which has traditionally been wasted space. Below the cylinders 22 is a shield which prevents leaks of hydraulic fluid through the ceiling of the coach 10. Further, to prevent leaks, the hydraulic cables are encased in a plastic sleeve so that if a leak does occur, the hydraulic fluid is contained within the sleeve.

Having thus described the invention in connection with the preferred embodiments thereof, it will be evident to those skilled in the art that various revisions can be made to the preferred embodiments described herein with out departing from the spirit and scope of the invention. It is my intention, however, that all such revisions and modifications that are evident to those skilled in the art will be included with in the scope of the following claims.

What is claimed is:

1. A synchronizing cylinder comprising:

a first chamber in fluid communication with a first mechanism cylinder; and a second chamber in fluid communication with a second mechanism cylinder;

wherein the volume of the first chamber is smaller than the volume of the second chamber and the volume of the first mechanism cylinder is smaller than the volume of the second mechanism cylinder so that actuation of the synchronizing cylinder causes the mechanism cylinders to move substantially the same distance at substantially the same speed;

wherein the first and second chambers further comprise a piston to move the fluid into or out of the respective chamber;

wherein the size of the rod that passes through the first chamber is larger than the size of the rod that passes through the second chamber thereby causing the volume the first chamber to be smaller than the volume of the second chamber;

wherein the first and second chambers each have a cap side and a rod side;

poppets having an open position in which the cap and rod sides of the first and second chambers are in fluid communication with each other and a closed position in which the cap sides of the chambers are in fluid communication with each other but the rod side of the chambers are isolated from each other; and members combined with the larger diameter rods to aid in actuating the poppets as the pistons are moved from a first position to a second position.

* * * * *